United States Patent [19]

Buckley, III

[11] Patent Number: 4,975,096

[45] Date of Patent: Dec. 4, 1990

[54] LONG CHAIN ALIPHATIC HYDROCARBYL AMINE ADDITIVES HAVING AN OXYALKYLENE HYDROXY CONNECTING GROUP

[75] Inventor: Thomas F. Buckley, III, Hercules, Calif.

[73] Assignee: Chevron Research Company, San Francisco, Calif.

[21] Appl. No.: 242,756

[22] Filed: Sep. 9, 1988

[51] Int. Cl.[5] ..... C10L 1/22

[52] U.S. Cl. ..... 44/433; 560/158; 560/159

[58] Field of Search ..... 44/71, 58, 72; 560/159, 560/158; 528/371

[56] References Cited

U.S. PATENT DOCUMENTS

| | | | |
|---|---|---|---|
| 3,806,456 | 4/1974 | Vogel | 44/71 |
| 4,128,403 | 12/1978 | Honnen | 44/71 |
| 4,134,846 | 1/1979 | Machleder et al. | 252/51.5 A |
| 4,247,301 | 1/1981 | Honnen | 44/63 |
| 4,322,220 | 3/1982 | Machleder et al. | 44/75 |
| 4,527,996 | 7/1985 | Campbell | 44/71 |
| 4,564,372 | 1/1986 | Campbell | 44/71 |
| 4,568,358 | 2/1986 | Courtney | 44/71 |
| 4,600,409 | 7/1986 | Campbell | 44/71 |

*Primary Examiner*—Olik Chaudhuri
*Assistant Examiner*—James M. Hunter, Jr.
*Attorney, Agent, or Firm*—C. J. Caroli; R. C. Gaffney

[57] ABSTRACT

Long chain aliphatic hydrocarbyl amine additives which comprise a long chain aliphatic hydrocarbyl component, an amine component and an oxy-alkylene hydroxy connecting group connecting the aliphatic hydrocarbyl component and amine component are useful as deposit control additives in fuel compositions and as dispersants in lubricating oil compositions.

37 Claims, No Drawings

LONG CHAIN ALIPHATIC HYDROCARBYL AMINE ADDITIVES HAVING AN OXYALKYLENE HYDROXY CONNECTING GROUP

BACKGROUND OF THE INVENTION

1. Field of the Invention

Numerous deposit-forming substances are inherent in hydrocarbon fuels. These substances when used in internal combustion engines tend to form deposits on and around constricted areas of the engine contacted by the fuel. Typical areas commonly and sometimes seriously burdened by the formation of deposits include carburetor ports, the throttle body and venturies, engine intake valves, etc.

Deposits adversely affect the operation of the vehicle. For example, deposits on the carburetor throttle body and venturies increase the fuel to air ratio of the gas mixture to the combustion chamber thereby increasing the amount of unburned hydrocarbon and carbon monoxide discharged from the chamber. The high fuel-air ratio also reduces the gas mileage obtainable from the vehicle.

Deposits on the engine intake valves when they get sufficiently heavy, on the other hand, restrict the gas mixture flow into the combustion chamber. This restriction starves the engine of air and fuel and results in a loss of power. Deposits on the valves also increase the probability of valve failure due to burning and improper valve seating. In addition, these deposits may break off and enter the combustion chamber possibly resulting in mechanical damage to the piston, piston rings, engine head, etc.

The formation of these deposits can be inhibited as well as removed after formation by incorporating an active detergent into the fuel. These detergents function to cleanse these deposit-prone areas of the harmful deposits, thereby enhancing engine performance and longevity. There are numerous detergent-type gasoline additives currently available which, to varying degrees, perform these functions.

Two factors complicate the use of such detergent-type gasoline additives. First, with regard to automobile engines that require the use of nonleaded gasolines (to prevent disablement of catalytic converters used to reduce emissions), it has been found difficult to provide gasoline of high enough octane to prevent knocking and the concomitant damage which it causes. The chief problem lies in the area of the degree of octane requirement increase, herein called "ORI", which is caused by deposits formed by the commercial gasoline.

The basis of the ORI problem is as follows: each engine, when new, requires a certain minimum octane fuel in order to operate satisfactorily without pinging and/or knocking. As the engine is operated on any gasoline, this minimum octane increases and, in most cases, if the engine is operated on the same fuel for a prolonged period, will reach an equilibrium. This is apparently caused by an amount of deposits in the combustion chamber. Equilibrium is typically reached after 5,000 to 15,000 miles of automobile operation.

The octane requirement increase in particular engines used with commercial gasolines will vary at equilibrium from 5 to 6 octane units to as high as 12 or 15 units, depending upon the gasoline compositions, engine design and type of operation. The seriousness of the problem is thus apparent. A typical automobile with a research octane requirement of 85, when new, may after a few months of operation require 97 research octane gasoline for proper operation, and little unleaded gasoline of that octane is available. The ORI problem also exists in some degree with engines operated on leaded fuels. U.S. Pat. Nos. 3,144,311; 3,146,203; and 4,247,301 disclose lead-containing fuel compositions having reduced ORI problems.

The ORI problem is compounded by the fact that the most common method for increasing the octane rating of unleaded gasoline is to increase its aromatic content. This, however, eventually causes an even greater increase in the octane requirement. Moreover, some of the presently used nitrogen-containing compounds used as deposit-control additives and their mineral oil or polymer carriers may also significantly contribute to ORI in engines using unleaded fuels.

It is, therefore, particularly desirable to provide deposit control additives which effectively control the deposits in intake systems of engines, without themselves eventually contributing to the problem.

In this regard, hydrocarbyl poly (oxyalkylene) aminocarbamates are commercially successful fuel additives which control combustion chamber deposits thus minimizing ORI.

The second complicating factor relates to the lubricating oil compatibility of the fuel additive. Fuel additives, due to their higher boiling point over gasoline itself, tend to accumulate on surfaces in the combustion chamber of the engine. This accumulation of the additive eventually finds its way into the lubricating oil in the crankcase of the engine via a "blow-by" process and/or via cylinder wall/piston ring "wipe down". In some cases, as much as 25%–30% of the non-volatile fuel components including fuel additives, will eventually accumulate in the lubricating oil. Insofar as the recommended drain interval for some engines may be as much as 7,500 miles or more, such fuel additives can accumulate during this interval to substantial quantities in the lubricating oil. In the case where the fuel additive is not sufficiently lubricating oil compatible, the accumulation of such an oil-incompatible fuel additive may actually contribute to crankcase deposits as measured by a Sequence V-D test.

The incompatibility of certain fuel additives in lubricating oils, i.e., oils which contain other additives, arises in spite of the fact that some fuel additives are also known to be lubricating oil dispersants.

Several theories exist as to the cause of the lubricating oil incompatibility of certain fuel additives. Without being limited to any theory, it is possible that some of these fuel additives when found in the lubricating oil interfere with other additives contained in the lubricating oil and either counterbalance the effectiveness of these additives or actually cause dissolution of one or more of these additives including possibly the fuel additive itself. In either case, the incompatibility of the fuel additive with other additives in the lubricating oil demonstrates itself in less than desirable crankcase deposits as measured by Sequence V-D engine tests.

In another theory, it is possible that the accumulation of the fuel additive into the lubricating oil during the drain interval period surpasses its maximum solubility in the lubricating oil. In this theory, this excess amount of fuel additive is insoluble in the lubricating oil and is what causes increased crankcase deposits.

In still another theory, it is possible that the fuel additive will decompose in the lubricating oil during engine operation and the decomposition products are what cause increased crankcase deposits.

In any case, lubricating oil incompatible fuel additives are less than desirable insofar as their use during engine operation will result in increased deposits in the crankcase. This problem can be severe. For example, hydrocarbyl poly(oxyalkylene) aminocarbamate fuel additives, including hydrocarbyl poly(oxybutylene) aminocarbamates, are known to possess dispersant properties in lubricating oil. In this regard, it is recognized that due to the poly(oxyalklylene group) the hydrocarbyl poly(oxyalkylene) aminocarbamates are substantially more expensive to synthesize than would be hydrocarbyl aminocarbamates and other hydrocarbyl amine compositions without a poly(oxyalkylene) group. Accordingly, it would be particularly advantageous to develop such compositions due to their being less expensive to manufacture and due to their chemical similarity to hydrocarbon-based lubricating oils and lubricating oil additives.

The present invention is directed to a novel class of dispersant additives which as a fuel additive controls combustion chamber deposits, thus minimizing ORI, and as a lubricating oil additive is compatible with the lubricating oil composition. These additives are also useful, themselves, as dispersants in lubricating oil compositions. The novel additives of the present invention are long chain aliphatic hydrocarbyl amine compositions having an epihalohydrin-derived connecting group connecting the long chain aliphatic hydrocarbyl component and the amine component.

Polyoxyalkylene carbamates comprising a hydroxyhydrocarbyloxy-terminated polyoxyalkylene chain of 2 to 5 carbon oxyalkylene units bonded through an oxycarbonyl group to a nitrogen atom of a polyamine have been taught as deposit control additives for use in fuel compositions. See, e.g., U.S. Pat. Nos. 4,160,648; 4,191,537; 4,236,020; and 4,288,612.

Hydrocarbylpoly(oxyalkylene) polyamines are also taught as useful as dispersants in lubricating oil compositions. See, e.g., U.S. Pat. No. 4,247,301.

The use of certain polyoxyalkylene amines in diesel fuels to improve operation of engines equipped with injectors has been taught. See, e.g., U.S. Pat. No. 4,568,358.

Polyoxyalkylene polyamines prepared by reacting an amine with a halogen-containing polyoxyalkylene polyol and a polyoxyalkylene glycol monoether derived from the reaction of a hydroxyl-containing compound having 1 to 8 hydroxyl groups and a halogen-containing compound are taught as fuel detergent additives. See, e.g., U.S. Pat. No. 4,261,704.

Polyalkylene polyamine other derivatives of polyoxyalkylene compounds prepared by first reacting a polyoxyalkylenepolyol having 1 to 8 hydrogen active sites with an epihalohydria and then reacting the resulting polyether with an amine are taught as useful as intermediates for the preparation of paper product-related items and as cross linking agents for synthetic resins. See e.g. U.S. Pat. No. 4,281,199.

SUMMARY OF THE INVENTION

The present invention is directed to a novel class of long chain aliphatic hydrocarbyl amine additives which comprise a long chain aliphatic hydrocarbyl component, an amine component and an oxy-alkylene hydroxy connecting group which joins the aliphatic hydrocarbyl component and the amine component, the connecting group having two oxygen atoms, a linking oxygen and a hydroxyl oxygen and wherein the linking oxygen atom of the connecting group is covalently bonded to a carbon atom of the aliphatic hydrocarbyl component and to a carbon atom of the remainder of the connecting group. The long chain aliphatic hydrocarbyl component is of sufficiently high molecular weight and of sufficiently long chain length that the resulting additive is soluble in liquid hydrocarbons including fuels boiling in the gasoline or diesel range and is compatible with lubricating oils.

These additives have advantageous dispersency when used in fuel compositions. In addition, unlike additives which contain an aliphatic hydrocarbyl component directly linked to an amine component, use of these additives in unleaded fuels do not cause the previously discussed problems with combustion chamber deposits and the consequent ORI. Additives having an aliphatic hydrocarbyl component directly linked to an amine component, when used as fuel additives in unleaded fuel, have been found to cause significant deposit build-up and the consequent ORI.

In addition, the present invention is directed to a fuel composition comprising a hydrocarbon boiling in the gasoline or diesel range and from about 30 to about 5000 parts per million of an aliphatic hydrocarbyl additive of the present invention.

The present invention is also directed to fuel concentrates comprising an inert stable oleophilic organic solvent boiling in the range of 150° F. to 400° F. and from about 5 to about 50 weight percent of an aliphatic hydrocarbyl additive of the present invention.

Additives of the present invention are also useful as dispersants and/or detergents for use in lubricating oil compositions. Accordingly, the present invention also relates to lubricating oil compositions comprising a major amount of oil of lubricating viscosity and an amount of additive sufficient to provide dispersancy and/or detergency. The additives of the present invention may also be formulated in lubricating oil concentrates which comprise from about 90 to about 50 weight percent of an oil of lubricating viscosity and from about 10 to about 50 weight percent of an additive of the present invention.

DETAILED DESCRIPTION OF THE INVENTION

The long chain aliphatic hydrocarbyl amine additives of the present invention comprise a long chain aliphatic hydrocarbyl component and an amine component which are joined by an epihalohydrin-derived connecting group through a linking oxygen. The connecting group may allow for thermal cleavage of the amine component from the aliphatic hydrocarbyl component so that the free remaining hydrocarbyl portion undergoes thermal oxidative decomposition in the combustion chamber and does not form deleterious deposits.

The Preferred Long Chain Aliphatic Hydrocarbyl Component

The long chain aliphatic hydrocarbyl component will be of sufficient chain length to render the resulting additive soluble in liquid hydrocarbons, including fuels boiling in the gasoline or diesel range and compatible with lubricating oils.

The hydrocarbyl component may be an aliphatic or alicyclic hydrocarbyl group and, except for adventitious amounts of aromatic structure which may be present in petroleum mineral oils, will be free of aromatic unsaturation. The hydrocarbyl groups are derived from petroleum mineral oil or polyolefins, either homopolymers or higher order polymers, of 1-olefins of from 2 to 6 carbon atoms, ethylene being polymerized with a higher homologue. The olefins may be mono- or polyunsaturated, but the polyunsaturated olefins require that the final product be rerduced to remove substantially all of the residual unsaturation, save 1 olefinic moiety.

Illustrative sources for the high molecular weight hydrocarbons from petroleum mineral oils are naphthenic bright stocks. For the polyolefin, illustrative polymers include polypropylene, polyisobutylene, poly-1-butene, copolymer of ethylene and isobutylene, copolymer of propylene and isobutylene, poly-1-pentene, poly-4-methyl-1-pentene, poly-1-hexene, poly-3-methylbutene-1, polyisoprene, etc.

The long chain aliphatic hydrocarbyl component will normally have at least 1 branch per 6 carbon atoms along the chain, preferably at least 1 branch per 4 carbon atoms along the chain, and particularly preferred that there be about 1 branch per 2 carbon atoms along the chain. These branched chain hydrocarbon groups are readily prepared by the polymerization of olefins of from 3 to 6 carbon atoms and preferably from olefins of from 3 to 4 carbon atoms, more preferably from propylene or isobutylene. The addition polymerizable olefins employed are normally 1- olefins. The branch will be of from 1 to 4 carbon atoms, more usually of from 1 to 2 carbon atoms and preferably methyl.

The long chain aliphatic hydrocarbyl component is of sufficiently high molecular weight to maintain detergency in the carburetor, fuel injectors and intake valves; typically chain lengths such that the long chain aliphatic hydrocarbyl component has on the order of 50 carbon atoms or greater suffice for such detergency.

The preferred long chain aliphatic hydrocarbyl component is derived from high molecular weight olefins or alcohols. Preferably high molecular weight alcohols prepared from the corresponding polymeric hydrocarbons or olefins may be used The polymeric hydrocarbons or olefins used to prepare the corresponding alcohols typically have an average molecular weight of from about 500 to about 5000. Preferred are polymeric hydrocarbons having an average molecular weight of about 700 to about 3000, more preferred are those from about 900 to about 2000; especially preferred are those of average molecular weight from about 950 to about 1600.

Preferred polymeric hydrocarbons used to prepare the alcohols include polypropylene, polyisopropylene, polybutylene and polyisobutylene. Preferred are those polymeric hydrocarbons having at least 50 carbons.

Particularly preferred are long chain aliphatic hydrocarbyl components which are derived from "reactive" polyisobutenes, that is polyisobutenes which comprise at least about 50% of the more reactive methylvinylidene isomer. Suitable polyisobutenes include those prepared using $BF_3$ catalysis. The preparation of such polyisobutenes is described in U.S. Pat. No. 4,605,808. Such reactive polyisobutenes will react to give high molecular weight alcohols in which the hydroxyl is at (or near) the end of the hydrocarbon chain.

The preferred long chain aliphatic hydrocarbyl components in the additives of the present invention are conveniently derived from alcohols which may be prepared from the corresponding olefins by conventional procedures. Such procedures include hydration of the double bond to give an alcohol.

Suitable procedures for preparing such long chain alcohols are described in the literature (See, e.g., H. C. Brown, *Organic Synthesis Via Boranes*, John Wiley & Sons (1975); I. T. Harrison and S. Harrison, "Compendium of Organic Synthetic Methods," Wiley—Interscience, New York (1971), pp. 119–122); and also in the Examples.

The Preferred Amine Component

The amine component of the long chain aliphatic hydrocarbyl amine additives of this invention is preferably derived from a polyamine having from 2 to about 12 amine nitrogen atoms and from 2 to about 40 carbon atoms. The polyamine is preferably reacted with an intermediate having an amine reactive site to produce the long chain aliphatic hydrocarbyl amine additives finding use within the scope of the present invention. The intermediate is itself derived from a long chain aliphatic hydrocarbyl alcohol by reaction with epichlorohydrin. The polyamine, encompassing diamines, provides the product, with, on average, at least about one basic nitrogen atom per product molecule, i.e., a nitrogen atom titratable by a strong acid. The polyamine preferably has a carbon-to-nitrogen ratio of from about 1:1 to about 10:1.

The polyamine may be substituted with substituents selected from (A) hydrogen, (B) hydrocarbyl groups of from 1 to about 10 carbon atoms, (C) acyl groups of from 2 to about 10 carbon atoms, and (D) monoketo, monohydroxy, mononitro, monocyano, lower alkyl and lower alkoxy derivatives of (B) and (C). "Lower", as used in terms like lower alkyl or lower alkoxy, means a group containing from 1 to about 6 carbon atoms. At least one of the substituents on one of the basic nitrogen atoms of the polyamine is hydrogen, e.g., at least one of the basic nitrogen atoms of the polyamine is a primary or secondary amino nitrogen atom.

Hydrocarbyl, as used in describing the amine component of this invention, denotes an organic radical composed of carbon and hydrogen which may be aliphatic, alicyclic, aromatic or combinations thereof, e.g., aralkyl. Preferably, the hydrocarbyl group will be relatively free of aliphatic unsaturation, i.e., ethylene and acetylenic, particularly acetylenic unsaturation. The substituted polyamines of the present invention are generally, but not necessarily, N-substituted polyamines. Exemplary hydrocarbyl groups and substituted hydrocarbyl groups include alkyls such as methyl, ethyl, propyl, butyl, isobutyl, pentyl, hexyl, octyl, etc., alkenyls such as propenyl, isobutenyl, hexenyl, octenyl, etc., hydroxyalkyls, such as 2-hydroxyethyl, 3-hydroxypropyl, hydroxy-isopropyl, 4-hydroxybutyl, etc., ketoalkyls, such as 2-ketopropyl, 6-ketooctyl, etc., alkoxy and lower alkenoxy alkyls, such as ethoxyethyl, ethoxypropyl, propoxyethyl, propoxypropyl, 2-(2-ethoxyethoxy)ethyl, 2-(2- (2-ethoxyethoxy)ethoxy)ethyl, 3,6,9,12-tetraoxatetradecyl, 2-(2-ethoxyethoxy)hexyl, etc. The acyl groups of the aforementioned (c) substituents are such as propionyl, acetyl, etc. The more preferred substituents are hydrogen, $C_1$–$C_6$ alkyls and $C_1$–$C_6$ hydroxyalkyls.

In a substituted polyamine the substituents are found at any atom capable of receiving them. The substituted atoms, e.g., substituted nitrogen atoms, are generally geometrically inequivalent, and consequently the substituted amines finding use in the present invention can be mixtures of mono- and poly-substituted polyamines with substituent groups situated at equivalent and/or inequivalent atoms.

The more preferred polyamine finding use within the scope of the present invention is a polyalkylene polyamine, including alkylene diamine, and including substituted polyamines, e.g., alkyl and hydroxyalkyl-substituted polyalkylene polyamine. Preferably, the alkylene group of the polyamine contains from 2 to 6 carbon atoms, there being preferably from 2 to 3 carbon atoms between the nitrogen atoms. Such alkylene groups are exemplified by ethylene, 1,2-propylene, 2,2-dimethylpropylene trimethylene, 1,3,2-hydroxypropylene, etc. Examples of such polyamines include ethylene diamine, diethylene triamine, di(trimethylene)triamine, dipropylene triamine, triethylene tetramine, tripropylene tetramine, tetraethylene pentamine, and pentaethylene hexamine. Such amines encompass isomers such as branched-chain polyamines and the previously mentioned substituted polyamines, including hydroxy- and hydro-carbyl-substituted polyamines. Among the polyalkylene polyamines, those containing 2–12 amine nitrogen atoms and 2–24 carbon atoms are especially preferred, and the $C_2$–$C_3$ alkylene polyamines are most preferred, in particular, the lower polyalkylene polyamines, e.g., ethylene diamine, diethylene triamine, propylene diamine, dipropylene triamine, etc. Especially preferred are ethylene diamine and diethylene triamine.

The amine component of the additives of the present invention also may be derived from heterocyclic polyamines, heterocyclic substituted amines and substituted heterocyclic compounds, wherein the heterocycle comprises one or more 5–6 membered rings containing oxygen and/or nitrogen. Such heterocycles may be saturated or unsaturated and substituted with groups selected from the aforementioned (A), (B), (C) and (D). The heterocycles are exemplified by piperazines, such as 2-methylpiperazine, N-(2-hydroxyethyl)piperazine, 1,2-bis-(N-piperazinyl)ethane, and N,N'-bis(N-piperazinyl)piperazine, 2-methylimidazoline, 3-aminopiperidine, 2-aminopyridine, 2-(3-aminoethyl)-3-pyrroline, 3-aminopyrrolidine, N-(3- aminopropyl)-morpholine, etc. Among the heterocyclic compounds, the piperazines are preferred.

Another class of suitable polyamines from which the amine component may be derived are diaminoethers represented by Formula IX $$H_2N—X_1(OX_2)_rNH_2 \qquad \text{IX}$$

wherein $X_1$ and $X_2$ are independently alkylene from 2 to about 5 carbon atoms and r is an integer from 1 to about 10. Diamines of Formula IX are disclosed in U.S. Pat. No. 4,521,610, which is incorporated herein by reference for its teaching of such diamines.

Typical polyamines that can be used to form the compounds of this invention by reaction with the intermediates include the following: ethylene diamine, 1,2-propylene diamine, 1,3-propylene diamine, diethylene triamine, triethylene tetramine, hexamethylene diamine, tetraethylene pentamine, dimethylaminopropylene diamine, N-(beta-aminoethyl)piperazine, N-(beta-aminoethyl)piperidine, 3-amino-N-ethylpiperidine, N-(beta-aminoethyl) morpholine, N,N'-di(beta-aminoethyl)piperazine, N,N'-di(beta-aminoethylimidazolidone-2; N(beta-cyanoethyl)ethane-1,2-diamine, 1-amino-3,6,9-triazaocta-decane, 1-amino-3,6-diaza-9-oxadecane, N-(beta-aminoethyl)diethanolamine, N'-acetyl-N'-methyl-N-(beta-aminoethyl)ethane-1,2-diamine, N-acetonyl-1,2-propane-diamine, N-(beta-amino ethyl)hexahydrotriazine, N-(beta-amino ethyl)hexahydrotriazine, 5-(beta-aminoethyl)-1,3,5-dioxazine, 2-(2-aminoethylamino)ethanol, 2[2-(2-amino-ethylamino)ethylamino]-ethanol.

In many instances the polyamine used as a reactant in the production of the additive of the present invention is not a single compound but a mixture in which one or several compounds, predominate with the average composition indicated. For example, tetraethylene pentamine prepared by the polymerization of aziridine or the reaction of dichloroethylene and ammonia will have both lower and higher amine members, e.g., triethylene tetramine, substituted piperazines and pentaethylene hexamine, but the composition will be mainly tetraethylene pentamine and the empirical formula of the total amine composition will closely approximate that of tetraethylene pentamine. Finally, in preparing the compounds of this invention, where the various nitrogen atoms of the polyamine are not geometrically equivalent, several substitutional isomers are possible and are encompassed within the final product. Methods of preparation of amines, isocyanates and their reactions are detailed in Sidgewick's "The Organic Chemistry of Nitrogen", Clarendon Press, Oxford, 1966; Nollers' "Chemistry of Organic Compounds", Saunders, Philadelphia, 2nd Ed. 1957; and Kirk-Othmer's "Encyclopedia of Chemical Technology", 2nd Ed., especially Volume 2, pp. 99–116.

The Connecting Group

The connecting group joining the long chain aliphatic hydrocarbyl component and the amine component is a diradical wherein the ether (linking) oxygen may be regarded as having been the terminal hydroxyl oxygen of the long chain alcohol from which the long chain aliphatic hydrocarbyl component was derived and the remainder of the connecting group is derived from epihalohydrin It functions to join the two components so that an oxygen atom of the connecting group is covalently bonded to a carbon atom of the long chain aliphatic hydrocarbyl component and to a carbon atom of the remainder of the connecting group.

Epihalohydrin has the formula:

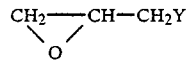

wherein Y is halogen. In the reaction of the alcohol with epihalohydrin followed by reaction with amine to give the additives of the present invention, the epoxide ring opens to give an hydroxyl-bearing connecting group. The ring opening reaction results in connecting groups having primarily one of two

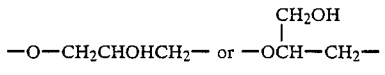

It is believed the reaction mechanism favors the —O—$CH_2CHOHCH_2$—group and it predominates.

Preferred Long Chain Aliphatic Hydrocarbyl Amine Additives

A generalized, preferred formula for the long chain aliphatic amine additives of the present invention is as follows:

$$R—X—Am \quad (I)$$

wherein R is an aliphatic hydrocarbyl component having a about at least 50 carbon atoms, as described hereinabove; Am is an amine component as described hereinabove; and X is a connecting group wherein the linking oxygen may be regarded as having been the terminal hydroxyl oxygen of the long chain alcohol from which the long chain aliphatic hydrocarbyl component was derived and the remainder of the connecting group is derived from epihalohydrin. The connecting group may have one of two different structures:

$$-O-CH_2CHOHCH_2- \text{ or } -O\overset{\overset{\displaystyle CH_2OH}{|}}{C}H-CH_2-$$

It is believed that the $-O-CH_2CHOHCH_2-$ connecting group structure predominates in the mixture of product additives.

The preferred long chain aliphatic hydrocarbyl amine additives employed in the present invention have at least one basic nitrogen atom per molecule. A "basic nitrogen atom" is one that is titratable by a strong acid, e.g., a primary, secondary or tertiary amino nitrogen, as distinguished from, for example, an amido nitrogen, i.e.,

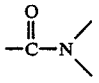

which is not so titratable. Preferably, the basic nitrogen is in a primary or secondary amino group.

The preferred long chain aliphatic amine additives of the present invention have an average molecular weight of from about 700 to about 3000, preferably an average molecular weight from about 1000 to about 2000, and most preferably an average molecular weight of from about 1000 to about 1600.

An especially preferred class of long chain aliphatic hydrocarbyl amine additives according to the present invention may be described by the formula:

$$R—O—CH_2CHOH—CH_2—NH\text{-}(R_1NH)_pH$$

wherein R is a polyisobutenyl group having a chain length of at least 50 carbon atoms, $R_1$ is alkylene of from 2 to about 6 carbon atoms, and p is an integer of from 1 to about 6.

General Preparation

The additives employed in the present invention may be conveniently prepared by first reacting the aliphatic hydrocarbyl alcohol with epihalohydrin to give an intermediate which is then capable of reacting with an amine to give the desired aliphatic hydrocarbyl amine additive.

Preparation of such aliphatic hydrocarbyl alcohols is well known to those skilled in the art. See, e.g., H. C. Brown, *Organic Synthesis Via Boranes*, John Wiley & Sons (1975).

Preparation of polyoxyalkylene polyamines wherein a halogenated ether is reacted with a polyamine is disclosed in U.S. Pat. No. 4,261,704. The disclosure of which is incorporated herein by reference.

Thus, the aliphatic hydrocarbyl alcohol is reacted with an epihalohydrin to give an intermediate having a halo end group. That alkyl halide intermediate is then reacted with the polyamine to give additives of the present invention.

The epihalohydrins used herein correspond to the formula:

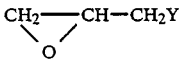

wherein Y is halogen. In practicing the invention the preferred epihalohydrin is either epichlorohydrin or epibromohydrin.

When the aliphatic hydrocarbyl alcohol is reacted with the epihalohydrin, a halohydrin ether intermediate is formed. Generally, the reaction is carried out at a temperature from about 30° C. to about 100° C., preferably in the range of about 50° C. to about 80° C. The reaction is generally complete within about 0.5 to about 5 hours. Typical reaction times are in the range of about 2 to about 4 hours. A solvent may be used; suitable solvents include xylene, benzene, toluene, $C_9$ aromatic solvents, naphthenic solvents and the like.

The reaction is carried out in the presence of a catalyst. Suitable catalysts are of the Friedel-Crafts type, for example, those such as $AlCl_3$, $BF_3$, $ZnCl_2$, and $FeCl_3$ etherates; acid catalysts such as HF, $H_2SO_4$, $H_3PO_4$ and the like. A preferred catalyst is borontrifluoride which is conveniently deployed in the form of an etherate. Generally, about 0.1 parts to about 5 parts catalyst per 100 parts by weight alcohol are used. Approximately equivalent amounts of epihalohydrin and alcohol are used.

The reaction of the resulting halohydrin ether intermediate with the amine may be carried out neat or preferably in solution. Suitable solvents include organic solvents such as xylene, $C_9$ aromatic solvents, naphthenic solvents and the like. The reaction is carried out at a temperature in the range of about 0° C. to about 200° C., preferably from about 100° C. to about 150° C. and is generally complete within about 4 to about 12 hours. The product is isolated by conventional procedures such as washing, stripping, usually with the aid of vacuum filtration and the like.

The mole ratio of amine to halohydrin ether intermediate will generally be in the range of about 1 to about 5 moles of amine per mole of halohydrin ether intermediate, and more usually about 2 to about 3 moles amine per mole intermediate. Since suppression of polysubstitution of the polyamine is usually desired, large molar excesses of the amine will be used. Additionally, the preferred adduct is the monoalkylamine compound as opposed to the bis-alkylamine or disubstituted amino ether.

The reaction or reactions may be carried out with or without the presence of a reaction solvent. A reaction solvent is generally employed whenever necessary to reduce the viscosity of the reactants and products and to minimize the formation of undesired by-products. These solvents should be stable and inert to the reactants and reaction product. Depending upon the temperature of the reaction, the particular halohydrin ether intermediate used, the mole ratios, as well as the reactant concentrations, the reaction time may vary from about 1 to about 24 hours.

After the reaction has been carried out for a sufficient period of time, the reaction mixture may be subjected to extraction with a hydrocarbon-water or hydrocarbon-alcohol-water medium to free the product from any low molecular weight amine salts which may have formed and any unreacted polyamine. The product may then be isolated by evaporation of the solvent. Further purification may be effected by conventional methods such as column chromatography on silicon gel.

Fuel Compositions

The long chain aliphatic hydrocarbyl amine additives of this invention will generally be employed in a hydrocarbon distillate fuel. The proper concentration of this additive necessary in order to achieve the desired detergency and dispersancy varies depending upon the type of fuel employed, the presence of other detergents, dispersants and other additives, etc. Generally, however, from 30 to 5,000 weight parts per million (ppm), and preferably 100 to 500 ppm and more preferably 200 to 300 ppm of long chain aliphatic hydrocarbyl amine additives per part of base fuel is needed to achieve the best results. When other detergents are present, a lesser amount of long chain aliphatic hydrocarbyl amine additive may be used. For performance as a carburetor detergent only, lower concentrations, for example 30 to 70 ppm may be preferred. Higher concentrations, i.e., 2,000 to 5,000 ppm may result in a clean-up effect on combustion chamber deposits.

The deposit control additive may also be formulated as a concentrate, using an inert stable oleophilic organic solvent boiling in the range of about 150° to 400° F. Preferably, an aliphatic or an aromatic hydrocarbon solvent is used, such as benzene, toluene, xylene or higher-boiling aromatics or aromatic thinners. Aliphatic alcohols of about 3 to 8 carbon atoms, such as isopropanol, isobutylcarbinol, n-butanol and the like, in combination with hydrocarbon solvents are also suitable for use with the detergent-dispersant additive. In the concentrate, the amount of additive will be ordinarily at least 5 percent by weight and generally not exceed 50 percent by weight, preferably from 10 to 30 weight percent.

When employing certain of the long chain aliphatic hydrocarbyl amine additives of this invention, particularly those having more than 1 basic nitrogen, it can be desirable to additionally add a demulsifier to the gasoline or diesel fuel composition. These demulsifiers are generally added at from 1 to 15 ppm in the fuel composition. Suitable demulsifiers include for instance L-1562 ®, a high molecular weight glycol capped phenol available from Petrolite Corp., Tretolite Division, St. Louis, Mo., and OLOA 2503Z ®, available from Chevron Chemical Company, San Francisco, Calif.

In gasoline fuels, other fuel additives may also be included such as antiknock agents, e.g., methylcyclopentadienyl manganese tricarbonyl, tetramethyl or tetraethyl lead, or other dispersants or detergents such as various substituted succinimides, amines, etc. Also included may be lead scavengers such as aryl halides, e.g., dichlorobenzene or alkyl halides, e.g., ethylene dibromide. Additionally, antioxidants, metal deactivators and demulsifiers may be present.

In diesel fuels, other well-known additives can be employed such as pour point depressants, flow improvers, cetane improvers, etc.

Lubricating Oil Compositions

The long chain aliphatic hydrocarbyl amine additives of this invention are useful as dispersant additives when employed in lubricating oils. When employed in this manner, the additive is usually present in from 0.2 to 10 percent by weight to the total composition, preferably at about 0.5 to 8 percent by weight and more preferably at about 1 to 6 percent by weight. The lubricating oil used with the additive compositions of this invention may be mineral oil or synthetic oils of lubricating viscosity and preferably suitable for use in the crankcase of an internal combustion engine. Crankcase lubricating oils ordinarily have a viscosity of about 1300 CSt 0° F. to 22.7 CSt at 210° F. (99° C.). The lubricating oils may be derived from synthetic or natural sources. Mineral oil for use as the base oil in this invention includes paraffinic, naphthenic and other oils that are ordinarily used in lubricating oil compositions. Synthetic oils include both hydrocarbon synthetic oils and synthetic esters. Useful synthetic hydrocarbon oils include liquid polymers of alpha olefins having the proper viscosity. Especially useful are the hydrogenated liquid oligomers of $C_6$ to $C_{12}$ alpha olefins such as 1-decene trimer. Likewise, alkyl benzenes of proper viscosity such as didodecyl benzene, can be used. Useful synthetic esters include the esters of both monocarboxylic acid and polycarboxylic acids as well as monohydroxy alkanols and polyols. Typical examples are didodecyl adipate, pentaerythritol tetracaproate, di-2-ethylhexyl adipate, dilaurylsebacate and the like. Complex esters prepared from mixtures of mono and dicarboxylic acid and mono and dihydroxy alkanols can also be used.

Blends of hydrocarbon oils with synthetic oils are also useful. For example, blends of 10 to 25 weight percent hydrogenated 1-decene trimer with 75 to 90 weight percent 150 SUS (100° F.) mineral oil gives an excellent lubricating oil base.

Lubricating oil concentrates are also included within the scope of this invention. The concentrates of this invention usually include from about 90 to 50 weight percent of an oil of lubricating viscosity and from about 10 to 50 weight percent of the additive of this invention. Typically, the concentrates contain sufficient diluent to make them easy to handle during shipping and storage. Suitable diluents for the concentrates include any inert diluent, preferably an oil of lubricating viscosity, so that the concentrate may be readily mixed with lubricating oils to prepare lubricating oil compositions. Suitable lubricating oils which can be used as diluents typically have viscosities in the range from about 35 to about 500 Saybolt Universal Seconds (SUS) at 100° F. (38° C.), although an oil of lubricating viscosity may be used.

Other additives which may be present in the formulation include rust inhibitors, foam inhibitors, corrosion inhibitors, metal deactivators, pour point depressants, antioxidants, and a variety of other well-known additives.

Also included within the scope of this invention are fully formulated lubricating oils containing a dispersant effective amount of long chain aliphatic hydrocarbyl amine additive. Contained in the fully formulated composition is:

1. an alkenyl succinimide, 2. a Group II metal salt of a dihydrocarbyl dithiophosphoric acid,
3. a neutral or overbased alkali or alkaline earth metal hydrocarbyl sulfonate or mixtures thereof, and
4. a neutral or overbased alkali or alkaline earth metal alkylated phenate or mixtures thereof.
5. a viscosity index (VI) improver.

The alkenyl succinimide is present to act as a dispersant and prevent formation of deposits formed during operation of the engine. The alkenyl succinimides are well-known in the art. The alkenyl succinimides are the reaction product of a polyolefin polymer-substituted succinic anhydride with an amine, preferably a polyalkylene polyamine. The polyolefin polymer-substituted succinic anhydrides are obtained by reaction of a polyolefin polymer or a derivative thereof with maleic anhydride. The succinic anhydride thus obtained is reacted with the amine compound. The preparation of the alkenyl succinimides has been described many times in the art. See, for example, U.S. Pat. Nos. 3,390,082; 3,219,666; and 3,172,892, the disclosure of which are incorporated herein by reference. Reduction of the alkenyl substituted succinic anhydride yields the corresponding alkyl derivative. The alkyl succinimides are intended to be included within the scope of the term "alkenyl succinimide". A product comprising predominantly mono- or bis-succinimide can be prepared by controlling the molar ratios of the reactants. Thus, for example, if one mole of amine is reacted with one mole of the alkenyl or alkyl substituted succinic anhydride, a predominantly momo-succinimide product will be prepared. If two moles of the succinic anhydride are reacted per mole of polyamine, a bis-succinimide will be prepared.

Particularly good results are obtained with the lubricating oil compositions of this invention when the alkenyl succinimide is polyisobutene-substituted succinic anhydride of a polyalkylene polyamine.

The polyisobutene from which the polyisobutene-substituted succinic anhydride is obtained by polymerizing isobutene can vary widely in its compositions. The average number of carbon atoms can range from 30 or less to 250 or more, with a resulting number average molecular weight of about 400 or less to 3,000 or more. Preferably, the average number of carbon atoms per polyisobutene molecule will range from about 50 to 100 with the polyisobutenes having a number average molecular weight of about 600 to about 1,500. More preferably, the average number of carbon atoms per polyisobutene molecule ranges from about 60 to about 90, and the number average molecular weight ranges from about 800 to about 2,500. The polyisobutene is reacted with maleic anhydride according to well-known procedures to yield the polyisobutene-substituted succinic anhydride.

In preparing the alkenyl succinimide, the substituted succinic anhydride is reacted with a polyalkylene polyamine to yield the corresponding succinimide. Each alkylene radical of the polyalkylene polyamine usually has from 2 up to about 8 carbon atoms. The number of alkylene radicals can range up to about 8. The alkylene radical is exemplified by ethylene, propylene, butylene, trimethylene, tetramethylene, pentamethylene, hexamethylene, octamethylene, etc. The number of amino groups generally, but not necessarily, is one greater than the number of alkylene radicals present in the amine, i.e., if a polyalkylene polyamine contains 3 alkylene radicals, it will usually contain 4 amino radicals. The number of amino radicals can range up to about 9. Preferably, the alkylene radical contains from about 2 to about 4 carbon atoms and all amine groups are primary or secondary. In this case, the number of amine groups exceeds the number of alkylene groups by 1. Preferably the polyalkylene polyamine contains from 3 to 5 amine groups. Specific examples of the polyalkylene polyamines include ethylenediamine, diethylenetriamine, triethylenetetramine, propylenediamine, tripropylenetetramine, tetraethylenepentamine, trimethylenediamine, pentaethylenehexamine, di(trimethylene)triamine, tri(hexamethylene)tetramine, etc.

Other amines suitable for preparing the alkenyl succinimide useful in this invention include the cyclic amines such as piperazine, morpholine and dipiperazines.

Preferably the alkenyl succinimides used in the compositions of this invention have the following formula:

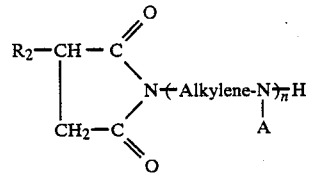

wherein:

(a) $R_2$ represents an alkenyl group, preferably a substantially saturated hydrocarbon prepared by polymerizing aliphatic monoolefins. Preferably $R_1$ is prepared from isobutene and has an average number of carbon atoms and a number average molecular weight as described above;

(b) the "Alkylene" radical represents a substantially hydrocarbyl group containing from 2 up to about 8 carbon atoms and preferably containing from about 2–4 carbon atoms as described hereinabove;

(c) A represents a hydrocarbyl group, an amine-substituted hydrocarbyl group, or hydrogen. The hydrocarbyl group and the amine-substituted hydrocarbyl groups are generally the alkyl and amino-substituted alkyl analogs of the alkylene radicals described above. Preferably A represents hydrogen;

(d) n represents an integer of from 1 to about 8, and preferably from about 3–5.

Also included within the term alkenyl succinimide are the modified succinimides which are disclosed in U.S. Pat. No. 4,612,132 which is incorporated herein by reference.

The alkenyl succinimide is present in the lubricating oil compositions of the invention in an amount effective to act as a dispersant and prevent the deposit of contaminants formed in the oil during operation of the engine. The amount of alkenyl succinimide can range from about 1 percent to about 20 percent weight of the total lubricating oil composition. Preferably the amount of alkenyl succinimide present in the lubricating oil composition of the invention ranges from about 1 to about 10 percent by weight of the total composition.

The alkali or alkaline earth metal hydrocarbyl sulfonates may be either petroleum sulfonate, synthetically alkylated aromatic sulfonates, or aliphatic sulfonates such as those derived from polyisobutylene. One of the more important functions of the sulfonates is to act as a detergent and dispersant. These sulfonates are well-known in the art. The hydrocarbyl group must have a sufficient number of carbon atoms to render the sulfonate molecule oil soluble. Preferably, the hydrocarbyl portion has at least 20 carbon atoms and may be aromatic or aliphatic, but is usually alkylaromatic. Most preferred for use are calcium, magnesium or barium sulfonates which are aromatic in character.

Certain sulfonates are typically prepared by sulfonating a petroleum fraction having aromatic groups, usually mono- or dialkylbenzene groups, and then forming the metal salt of the sulfonate acid material. Other feedstocks used for preparing these sulfonates include synthetically alkylated benzenes and aliphatic hydrocarbons prepared by polymerizing a mono- or diolefin, for example, a polyisobutenyl group prepared by polymerizing isobutene. The metallic salts are formed directly or by metathesis using well-known procedures.

The sulfonates may be neutral or overbased having base numbers up to about 400 or more. Carbon dioxide and calcium hydroxide or oxide are the most commonly used material to produce the basic or overbased sulfonates. Mixtures of neutral and overbased sulfonates may be used. The sulfonates are ordinarily used so as to provide from 0.3% to 10% by weight of the total composition. Preferably, the neutral sulfonates are present from 0.4% to 5% by weight of the total composition and the overbased sulfonates are present from 0.3% to 3% by weight of the total composition.

The phenates for use in this invention are those conventional products which are the alkali or alkaline earth metal salts of alkylated phenols. One of the functions of the phenates is to act as a detergent and dispersant. Among other things, it prevents the deposition of contaminants formed during the high temperature operation of the engine. The phenols may be mono- or polyalkylated.

The alkyl portion of the alkyl phenate is present to lend oil solubility to the phenate. The alkyl portion can be obtained from naturally occurring or synthetic sources. Naturally occurring sources include petroleum hydrocarbons such as white oil and wax. Being derived from petroleum, the hydrocarbon moiety is a mixture of different hydrocarbyl groups, the specific composition of which depends upon the particular oil stock which was used as a starting material. Suitable synthetic sources include various commercially available alkenes and alkane derivatives which, when reacted with the phenol, yield an alkylphenol. Suitable radicals obtained include butyl, hexyl, octyl, decyl, dodecyl, hexadecyl, eicosyl, tricontyl, and the like. Other suitable synthetic sources of the alkyl radical include olefin polymers such as polypropylene, polybutylene, polyisobutylene and the like.

The alkyl group can be straight-chained or branch-chained, saturated or unsaturated (if unsaturated, preferably containing not more than 2 and generally not more than 1 site of olefinic unsaturation). The alkyl radicals will generally contain from 4 to 30 carbon atoms. Generally when the phenol is monoalkyl-substituted, the alkyl radical should contain at least 8 carbon atoms. The phenate may be sulfurized if desired. It may be either neutral or overbased and if overbased, will have a base number of up to 200 to 300 or more. Mixtures of neutral and overbased phenates may be used.

The phenates are ordinarily present in the oil to provide from 0.2% to 27% by weight of the total composition. Preferably, the neutral phenates are present from 0.2% to 9% by weight of the total composition and the overbased phenates are present from 0.2 to 13% by weight of the total composition. Most preferably, the overbased phenates are present from 0.2% to 5% by weight of the total composition. Preferred metals are calcium, magnesium, strontium or barium.

The sulfurized alkaline earth metal alkyl phenates are preferred. These salts are obtained by a variety of processes such as treating the neutralization product of an alkaline earth metal base and an alkylphenol with sulfur. Conveniently the sulfur, in elemental form, is added to the neutralization product and reacted at elevated temperatures to produce the sulfurized alkaline earth metal alkyl phenate.

If more alkaline earth metal base were added during the neutralization reaction than was necessary to neutralize the phenol, a basic sulfurized alkaline earth metal alkyl phenate is obtained. See, for example, the process of Walker et al, U.S. Pat. No. 2,680,096. Additional basicity can be obtained by adding carbon dioxide to the basic sulfurized alkaline earth metal alkyl phenate. The excess alkaline earth metal base can be added subsequent to the sulfurization step but is conveniently added at the same time as the alkaline earth metal base is added to neutralize the phenol.

Carbon dioxide and calcium hydroxide or oxide are the most commonly used material to produce the basic or "overbased" phenates. A process wherein basic sulfurized alkaline earth metal alkylphenates are produced by adding carbon dioxide is shown in Hanneman, U.S. Pat. No. 3,178,368.

The Group II metal salts of dihydrocarbyl dithiophosphoric acids exhibit wear, antioxidant and thermal stability properties. Group II metal salts of phosphorodithioic, acids have been described previously. See, for example, U.S. Pat. No. 3,390,080, columns 6 and 7, wherein these compounds and their preparation are described generally. Suitably, the Group II metal salts of the dihydrocarbyl dithiophosphoric acids useful in the lubricating oil composition of this invention contain from about 4 to about 12 carbon atoms in each of the . hydrocarbyl radicals and may be the same or different and may be aromatic, alkyl or cycloalkyl. Preferred hydrocarbyl groups are alkyl groups containing from 4 to 8 carbon atoms and are represented by butyl, isobutyl, sec.-butyl, hexyl, isohexyl, octyl, 2-ethylhexyl and the like. The metals suitable for forming these salts include barium, calcium, strontium, zinc and cadmium, of which zinc is preferred.

Preferably, the Group II metal salt of a dihydrocarbyl dithiophosphoric acid has the following formula:

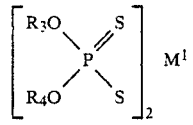

wherein:

(e) $R_3$ and $R_4$ each independently represent hydrocarbyl radicals as described above, and (f) $M_1$ represents a Group II metal cation as described above.

The dithiophosphoric salt is present in the lubricating oil compositions of this invention in an amount effective to inhibit wear and oxidation of the lubricating oil. The amount ranges from about 0.1 to about 4 percent by weight of the total composition, preferably the salt is present in an amount ranging from about 0.2 to about 2.5 percent by weight of the total lubricating oil composition. The final lubricating oil composition will ordinarily contain 0.025 to 0.25% by weight phosphorus and preferably 0.05 to 0.15% by weight.

Viscosity index (VI) improvers are either non-dispersant or dispersant VI improvers. Non-dispersant VI improvers are typically hydrocarbyl polymers including copolymers and terpolymers. Typically hydrocarbyl copolymers are copolymers of ethylene and propylene. Such non-dispersant VI improvers are disclosed in U.S. Pat. Nos. 2,700,633; 2,726,231; 2,792,288; 2,933,480; 3,000,866; 3,063,973; and 3,093,621 which are incorporated herein by reference for their teaching of non-dispersant VI improvers.

Dispersant VI improvers can be prepared by functionalizing non-dispersant VI improvers. For example, non-dispersant hydrocarbyl copolymer and terpolymer VI improvers can be functionalized to produce aminated oxidized VI improvers having dispersant properties and a number average molecular weight of from 1,500 to 20,000. Such functionalized dispersant VI improvers are disclosed in U.S. Pat. Nos. 3,864,268; 3,769,216; 3,326,804; and 3,316,177 which are incorporated herein by reference for their teaching of such dispersant VI improvers.

Other dispersant VI improvers include amine-grafted acrylic polymers and copolymers wherein one monomer contains at least one amino group. Typical compositions are described in British Pat. No. 1,488,382; and U.S. Pat. Nos. 4,89,794, and 4,025,452, which are incorporated herein by reference for their teaching of such disperasnt VI improvers.

Non-dispersant and dispersant VI improvers are generally employed at from 5 to 20 percent by weight in the lubricating oil composition.

The following examples are offered to specifically illustrate this invention. These examples and illustrations are not to be construed in any way as limiting the scope of this invention.

EXAMPLES

Example 1

Preparation of Polyisobutyl-24 Alcohol

To a dry, one liter, three-necked, round bottom flask equipped with an addition funnel, condenser and a mechanical stirring apparatus, 50 g (0.0525 moles) of polyisobutene-24 (average molecular weight about 950) dissolved in 200 ml of dry tetrahydrofuran/(THF) were added. The reaction vessel was cooled to 0° C. while being protected from moisture using a nitrogen atmosphere. Then, 53 ml of a 1M solution of $BH_3$/THF was added dropwise over about 25 minutes. The mixture was then warmed to room temperature and stirred for approximately three hours.

At that point, 10 ml water were added dropwise to the mixture in a cautious manner to avoid excessive foaming. When the addition of water was complete, the vessel was again cooled to 0° C. and then treated with 18 ml of aqueous 3M sodium hydroxide, followed by 15 ml of 30% hydrogen peroxide. The reaction mixture was then heated to 50° C. for 2½ hours with stirring. An additional 25 ml portion of 3M aqueous sodium hydroxide was added and the stirring was continued for an additional 0.5 hours.

After cooling, the reaction mixture was extracted three times with 500 ml hexane. The combined organic phases were washed twice with water (about 500 ml each); once with brine (about 300 ml); and then dried, filtered, and stripped to give 45.2 ml of the product polyisobutyl alcohol [IR: OH−3460 $cm^{-1}$; Hydroxyl No. 56]. The product was used in Example 2 without further purification.

Example 2

Preparation of Polyisobutyl-24 Alkylchloride

To a three-necked, 500 ml, round bottom flask equipped with a mechanical stirrer, condenser, heating mantle and protected from moisture (with a nitrogen atmosphere), a solution containing 53 g (0.05 ml) of polyisobutyl-24 alcohol (prepared according to the procedure outlined in Example 1) and 65 ml xylene was added. To the flask, 6.1 g (124 M%) epichlorohydrin was added in one portion together with 0.5 ml (0.557 g) boron trifluoride etherate. The reaction mixture was then heated with stirring to 65° C. for about 3 hours. The temperature of the reaction mixture was then raised to 80° C. and held at that temperature for an additional two hours.

After removing the heat source, the reaction mixture was quenched with 2 g sodium bicarbonate, stirred for 15 minutes and then allowed to stand overnight. The solids were removed by suction filtration. The filtrate containing the above-identified product was diluted to 150 ml with xylene and used in the procedure described in Example 3 without further purification and/or isolation.

Example 3

Preparation of Polybutyl-24 Amino Ether

A 500 ml round bottom three-necked flask equipped with a mechanical stirrer, condenser, heating mantle and protected from moisture (with a $N_2$ atmosphere) was charged with 150 ml of the alkyl chloride (in xylene) mixture (product of Example 2) and 112 ml (100 g) ethylene diamine. The stirred reaction mixture was heated to 120° C. and stirred at that temperature for 4 hours. Then xylene and excess ethylene diamine were removed by vacuum distillation. The residue was diluted with hexane, washed sequentially three times with strong aqueous base (NaOH), and once with brine, then dried over magnesium sulfate, filtered and stripped to give the above-identified product as a clear amber viscous oil (AV =93).

Example 4

Preparation of Polyisobutyl-32 Alcohol

A polyisobutyl alcohol was prepared from polyisobutene-32 (average molecular weight about 1300) by following the procedure described in Example 1 but using the following proportions of materials: 555 g of polyisobutene-32 was dissolved in 2-1 of tetrahydrofuran (THF) and then treated with 400 ml of a 1M solution of $BH_3$/THF. The reaction mixture was quenched with 80 ml water, followed by 135 ml aqueous 3M sodium hydroxide and then followed by 55 ml of 30% hydrogen peroxide. After isolation, 542 g of the above-identified product were obtained as a thick hazy liquid, having a hydroxyl number of 48.0.

Example 5

Preparation of Polyisobutyl-32 Alkyl Chloride

The above-identified alkyl chloride was prepared from polyisobutyl-32 alcohol prepared according to Example 4 by following the procedure described in Example 2 and using the following amounts of the following materials: 53 g of polyisobutyl-32 alcohol dissolved in 65 ml xylene was treated with 4.25 ml of epichlorohydrin and 0.5 ml of $BF_3$ etherate to give 57 g of the above-identified alkyl chloride. The alkyl chloride, after dilution with 50 ml xylene, may be used to prepare the corresponding amino ether.

Example 6

Preparation of Polyisobutyl-32 Amino Ether

Polyisobutyl-32 alkylamine was prepared from the corresponding alkyl chloride (prepared according to the procedure described in Example 5) using the following proportions of the following materials. A solution of 57 g of polyisobutyl-32-alkyl chloride in 50 ml xylene was treated with 100 g ethylene diamine to give 58 g of the above-identified amino ether as a thick tan oil (AV=50.8)

Example A

The stability of certain fuel additives prepared according to the procedures outlined in Examples 1 to 3 was measured by thermogravimetric analysis (TGA). The TGA procedure employed Du Pont 951 TGA instrumentation coupled with a microcomputer for data analysis. Samples of the fuel additives (approximately 25 milligrams) were heated isothermally at 200° C. under air flowing at 100 cubic centimeters per minute. The weight of the sample was monitored as a function of time. Incremental weight loss is considered to be a first order process. Kinetic data, i.e., rate constants and half-lives, were readily determined from the accumulated TGA data. The half-like measured by this procedure represents the time it takes for half of the additive to decompose. Half-like data for a fuel additive correlates to the likelihood that that additive will contribute to ORI. Lower half-lives represent a more easily decomposable product —one which will not as likely accumulate and form deposits in the combustion chamber. Higher half-lives, those approaching 900 minutes, would indicate an ORI problem in engine performance. The half-like results obtained are shown in Table I below.

TABLE I

| Compound | TGA Half Life (Min) |
|---|---|
| Compound of Example 3 Polyisobutyl-24 Amino Ether[1] | 280 |
| Compound of Example 6 Polyisobutyl-32 Amino Ether[2] | 650 |
| Comparison (F-309)[3] | 900 |

[1]Polyisobutyl-24 = 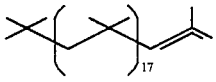 Mol. Wt. ~950

[2]Polyisobutyl-32 = 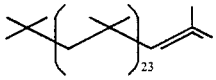 Mol. Wt. ~1300

[3]Polyisobutenyl-32 ethylenediamine prepared according to U.S. Pat. No. 3,574,576.

I claim:

1. A long chain aliphatic hydrocarbyl amine additive comprising a long chain aliphatic hydrocarbyl component, a amine component and an oxy-alkylene hydroxy connecting group which joins said aliphatic hydrocarbyl component and said amine component, the connecting group having at least two oxygen atoms, linking oxygen and a hydroxyl oxygen wherein the linking oxygen atom of the connecting group is covalently bonded to a carbon atom of said long chain aliphatic hydrocarbyl component and to a carbon atom of the remainder of the connecting group, and said long chain aliphatic hydrocarbyl component is of sufficient molecular weight and chain length that said additive is soluble in hydrocarbons boiling in a gasoline or diesel range.

2. An additive according to claim 1 wherein said amine component has at least one basic nitrogen atom titratable by strong acid.

3. An additive according to claim 2 wherein said long-chain aliphatic hydrocarbyl component has at least about 50 carbon atoms.

4. An additive according to claim 3 in which at least one basic nitrogen atom in said amine component is in a primary or secondary amino group.

5. An additive according to claim 3 wherein the amine component is derived from a polyamine having from 2 to 12 amine nitrogen atoms and from 2 to 40 carbon atoms with a carbon:nitrogen ratio between 1:1 and 10:1.

6. An additive according to claim 5 in which said polyamine is a substituted polyamine with substituents selected from (A) hydrogen, (B) hydrocarbyl groups of from 1 to about 10 carbon atoms, (C) acyl groups of from 2 to about 10 carbon atoms, and (D) monoketo, monohydroxy, mononitro, monocyano, lower alkyl and lower alkoxy derivatives of (B) and (C).

7. An additive according to claim 5 wherein said polyamine is a polyalkylene polyamine wherein the alkylene group contains from 2 to 6 carbon atoms and the polyamine contains 2 to 12 amine nitrogen atoms and 2 to 24 carbon atoms.

8. An additive according to claim 7 wherein said polyalkylene polyamine is selected from the group consisting of ethylene diamine, propylene diamine, butylene diamine, pentylene diamine, hexylene diamine, diethylene triamine, dipropylene triamine, triethylene tetramine, tetraethylene pentamine, and 1,3-diamino propane.

9. An additive according to claim 8 wherein said aliphatic hydrocarbyl component comprises a polymeric hydrocarbon having an average molecular weight of about 700 to about 3000.

10. An additive according to claim 9 wherein said aliphatic hydrocarbyl component comprises polyisobutylene having an average molecular weight of about 900 to 2000.

11. An additive according to claim 10 wherein said polyamine is ethylene diamine, diethylene triamine, triethylene tetramine, tetraethylene pentamine, or 1,3-diamino propane.

12. An additive according to claim 11 wherein said connecting group is $$-OCH_2CHOHCH_2- \text{ or } -O\overset{\overset{\displaystyle CH_2OH}{|}}{C}HCH_2- \text{ or mixtures thereof.}$$

13. An additive according to claim 12 wherein said aliphatic hydrocarbyl component comprises polyisobutylene having an average molecular weight of about 950 to about 1600.

14. An additive according to claim 13 wherein said polyamine is ethylene diamine or diethylene triamine.

15. An additive according to claim 14 wherein said aliphatic hydrocarbyl component has an average molecular weight of about 950.

16. An additive according to claim 14 wherein said aliphatic hydrocarbyl component has an average molecular weight of about 1300.

17. A long chain aliphatic hydrocarbyl amine additive of the formula:

$$R—X—Am$$

wherein R is an aliphatic hydrocarbyl component having a chain length of at least 50 carbon atoms; Am is a amine component having at least one basic nitrogen atom; and X is a connecting group of the formula selected from $$—O—CH_2CHOH—CH_2— \text{ and } —O\overset{\overset{\displaystyle CH_2OH}{|}}{C}H—CH_2— \text{ or}$$

mixtures thereof.

18. An additive according to claim 17 wherein X is predominately $—OCH_2CHOHCH_2—$.

19. An additive according to claim 18 wherein R is polyisobutylene or polypropylene.

20. An additive according to claim 19 wherein Am is selected from ethylene diamine, diethylene triamine, triethylene tetramine, tetraethylene pentamine or 1,3-diamino propane.

21. An additive according to claim 20 wherein R is polyisobutylene having an average molecular weight of about 900 to about 2000.

22. An additive according to claim 21 wherein Am is ethylene diamine or diethylene triamine.

23. An additive according to claim 22 wherein R is polyisobutyl-24 or polyisobutyl-32.

24. A long chain aliphatic hydrocarbyl amine additive selected from the formulas:

$$R—O—CH_2CHOHCH_2—NH\left(R_1NH\right)_pH$$

and $$R—O\overset{\overset{\displaystyle CH_2OH}{|}}{C}H—CH_2—NH\left(R_1NH\right)_pH \text{ or mixtures thereof}$$

wherein R is an aliphatic hydrocarbyl moiety having an average chain length of at least 50 carbon atoms; $R_1$ is alkylene of from 2 to 6 carbon atoms and p is an integer from 1 to 6.

25. An additive according to claim 24 wherein R is polypropyl, polybutyl or polyisobutyl.

26. An additive according to claim 25 wherein R is polyisobutylene having an average molecular weight of from about 700 to about 3000.

27. An additive according to claim 26 wherein $R_1$ is ethylene.

28. An additive according to claim 27 wherein p is 1 or 2.

29. An additive according to claim 28 wherein R is polyisobutyl-24 or polyisobutyl-32.

30. A fuel composition comprising a hydrocarbon boiling in a gasoline or diesel range and from about 30 to about 5000 parts per million of a long chain aliphatic hydrocarbyl amine additive comprising a long chain aliphatic hydrocarbyl component, an amine component and an oxy-alkylene hydroxy connecting group which joins said aliphatic hydrocarbyl component and said amine component, the connecting group having at least two oxygen atoms, linking oxygen and a hydroxyl oxygen wherein the linking oxygen atom of the connecting group is covalently bonded to a carbon atom of said long chain aliphatic hydrocarbyl component and to a carbon atom of the remainder of the connecting group, and said long chain aliphatic hydrocarbyl component is of sufficient molecular weight and chain length that said additive is soluble in hydrocarbons boiling in a gasoline or diesel range.

31. A fuel composition comprising a hydrocarbon boiling in a gasoline or diesel range and from about 30 to about 5000 parts per million of a long chain aliphatic hydrocarbyl amine additive of the formula:

$$R—X—Am$$

wherein R is an aliphatic hydrocarbyl component having a chain length of at least 50 carbon atoms; Am is an amine component having at least one basic nitrogen atom; and X is a connecting group of the formula selected from $$—O—CH_2CHOH—CH_2— \text{ and } —O\overset{\overset{\displaystyle CH_2OH}{|}}{C}H—CH_2— \text{ or}$$

or mixtures thereof.

32. A fuel composition comprising a hydrocarbon boiling in a gasoline or diesel range and from about 30 to about 5000 parts per million of a long chain aliphatic hydrocarbyl amine additive selected from the formulas:

$$R—O—CH_2CHOHCH_2—NH\left(R_1NH\right)_pH$$

and $$R—O\overset{\overset{\displaystyle CH_2OH}{|}}{C}H—CH_2—NH\left(R_1NH\right)_pH$$

or mixtures thereof wherein R is an aliphatic hydrocarbyl moiety having an average chain length of at least 50 carbon atoms; $R_1$ is alkylene of from 2 to 6 carbon atoms and p is an integer from 1 to 6.

33. The fuel composition according to claim 32, wherein R is polyisobutyl-24 or polyisobutyl-32, $R_1$ is ethylene and p is 1 or 2.

34. A fuel concentrate comprising a inert stable oleophilic organic solvent boiling in the range of 150° F. to 400° F. and from about 5 to about 50 weight percent of a long chain aliphatic hydrocarbyl amine additive comprising a long chain aliphatic hydrocarbyl component, an amine component and an oxyalkylene hydroxy connecting group which joins said aliphatic hydrocarbyl component and said amine component, the connecting group having at least two oxygen atoms, linking oxygen and a hydroxyl oxygen wherein the linking oxygen atom of the connecting group is covalently bonded to a carbon atom of said long chain aliphatic hydrocarbyl component and to a carbon atom of the remainder of the connecting group, and said long chain aliphatic hydrocarbyl component is of sufficient molecular weight and chain length that said additive is soluble in hydrocarbons boiling in a gasoline or diesel range.

35. A fuel concentrate comprising an inert stable oleophilic organic solvent boiling in the range of 150° F. to 400° F. and from about 5 to about 50 weight percent of a long chain aliphatic hydrocarbyl amine additive of the formula:

$$R—X—Am$$

wherein R is an aliphatic hydrocarbyl component having a chain length of at least 50 carbon atoms; Am is an amine component having at least one basic nitrogen atom; and X is a connecting group of the formula selected from $$—O—CH_2CHOH—CH_2— \text{ and } —O\overset{\overset{\displaystyle CH_2OH}{|}}{C}H—CH_2— \text{ or}$$

mixtures thereof.

36. A fuel concentrate comprising an inert stable oleophilic organic solvent boiling in the range of 150° F. to 400° F. and from about 5 to about 50 weight percent of a long chain aliphatic hydrocarbyl amine additive selected from the formulas:

$$R—O—CH_2CHOHCH_2—NH\left(R_1NH\right)_pH$$

and $$R—O\overset{\overset{\displaystyle CH_2OH}{|}}{C}H—CH_2—NH\left(R_1NH\right)_pH$$

or mixtures thereof wherein R is an aliphatic hydrocarbyl moiety having an average chain length of at least 50 carbon atoms; $R_1$ is alkylene of from 2 to 6 carbon atoms and p is an integer from 1 to 6.

37. The fuel concentrate according to claim 36, wherein R is polyisobutyl-24 or polyisobutyl-32, $R_1$ is ethylene and p is 1 or 2.

* * * * *